United States Patent [19]

McKay

[11] 3,942,682

[45] Mar. 9, 1976

[54] ELEVATING DEVICE FOR A FACIAL TISSUE BOX

[76] Inventor: Douglas H. McKay, 237 Betty Ann Drive, Willowdale, Ontario, Canada

[22] Filed: Aug. 15, 1974

[21] Appl. No.: 497,575

[52] U.S. Cl. ..... 221/58; 206/45.16; 206/494; 312/71; 211/51

[51] Int. Cl.[2] ..... B65H 1/08

[58] Field of Search ..... 221/52, 56–60, 221/279, 280; 206/74, 494, 45.16; 312/61, 71; D6/96, 98; 267/160; 248/300; 220/93; 211/49 D

[56] References Cited

UNITED STATES PATENTS

| | | | |
|---|---|---|---|
| 601,144 | 3/1898 | Howe | 221/59 |
| 953,953 | 4/1970 | Inglee | 312/61 |
| 1,209,054 | 12/1916 | Skall | 221/52 |
| 1,796,262 | 3/1931 | Gaisman | 221/58 |
| 2,439,690 | 4/1948 | Lippenberger | 248/174 |
| 2,522,427 | 9/1950 | Borden | 221/58 |

*Primary Examiner*—Robert B. Reeves
*Assistant Examiner*—H. Grant Skaggs, Jr.

[57] ABSTRACT

An elevating device for use in a box of facial tissues for the purpose of elevating the stack of tissues therein comprises a unitary structure of a resiliently flexible plastics material, such as polyethylene. The structure includes a central platform on which the stack of tissues is supported and resiliently splayable legs integrally formed with the platform along opposite transverse edges thereof. Longitudinally extending and generally central fingers are usefully also integrally formed with the platform to provide additional support for the stack of tissues.

2 Claims, 5 Drawing Figures

ELEVATING DEVICE FOR A FACIAL TISSUE BOX

BACKGROUND OF THE INVENTION

The present invention relates generally to elevating devices and more particularly to an elevating device intended to be inserted into a box of facial tissues for the purpose of facilitating the progressive removal of tissues from such a box through a discharge opening in the top wall of the box.

With presently available boxes of tissues, it is frequently difficult for a person to remove a single tissue from the box in the intended manner after some of the tissues have already been removed. One previously proposed solution to this problem has been directed to the serial but releasable interconnection of the tissues so that, as one tissue is removed through the opening, a subsequent tissue is partially unfolded and pulled into the neck of the discharge opening. Such a known system has, however, shown some tendency to be somewhat unreliable in that the desired separation of two connected tissues is not always obtained in the neck of the discharge opening while, on other occasions, successive tissues sometimes separate within the box or container.

It is accordingly a principal object of this invention to provide an elevating device intended to be inserted below the tissues in a box containing a stack of such tissues so as to be effective to facilitate the sequential removal of tissues through the discharge opening at all times and particularly after the stack of tissues has been substantially depleted.

Another object of this invention is to provide an elevating device for the aforementioned purpose which device, although reliable and effective in its operation and function, has a very simple construction and can, therefore, be manufactured at an extremely low unit cost.

Yet another object of this invention is to provide a device of the aforesaid type and which is suitable for use in most of the tissue boxes presently in commercial use.

Other objects of this invention and the manner in which such objects are achieved in accordance therewith will become apparent as the description herein proceeds.

SUMMARY OF THE INVENTION

Broadly, the present invention provides an elevating device for disposition in a box containing a stack of tissues below such a stack, which device comprises a unitary structure of a resiliently flexible plastics material including a generally central platform and longitudinally spaced apart and resiliently splayable legs integrally formed with said platform and extending downwardly therefrom in their unflexed state whereby, when said elevating device is disposed below a stack of tissues within a box with said legs thereof splayed apart, said device is effective, by virtue of the resilient flexibility of said legs, to urge such a stack of tissues upwardly for abutment of such a stack with an undersurface of a top wall of such a box for sequential removal of topmost ones of the tissues through a discharge opening in the top wall of the box and whereby said legs of said device are progressively and resiliently returned toward their unflexed downwardly extending orientation thereby progressively to elevate said platform and the stack of tissues supported thereon.

In accordance with one particular feature of this invention, an elevating device in accordance therewith is formed with resiliently flexible tissue-supporting fingers integrally formed with the platform of the device. Such fingers usefully extend in their unflexed state angularly upwardly relative to the platform from opposed transverse edges thereof. The manner in which such fingers function in such a construction will be more readily understood as the description herein proceeds, as will other advantages and features of this invention.

BRIEF DESCRIPTION OF THE DRAWINGS

The invention will now be described merely by way of illustration with reference to the accompanying drawings in which.

DESCRIPTION OF THE PREFERRED EMBODIMENTS

Figure 1:
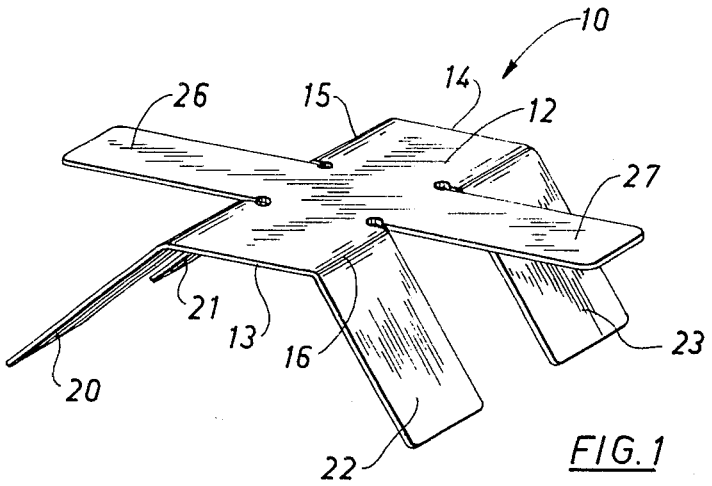
FIG. 1 is a perspective view of one embodiment of an elevating device in accordance with this invention.

Referring first to FIG. 1, there is indicated therein generally at 10, one embodiment of an elevating device in accordance with this invention. The device 10 includes a platform 12 defined by side edges 13 and 14 and spaced apart transverse edges 15 and 16 with transversely spaced apart legs 20, 21 and 22, 23 respectively which legs in their unflexed state extend downwardly as shown in FIG. 1 but which can be resiliently splayed apart into positions corresponding to thos shown in FIG. 2.

Referring further to FIG. 1, it will be seen therefrom that the platform 12 of the elevating device 10 is also integrally formed with fingers 26 and 27 which extend longitudinally from the transverse edges 15 and 16 respectively of the platform 12 generally centrally relative thereto.

Figure 2:
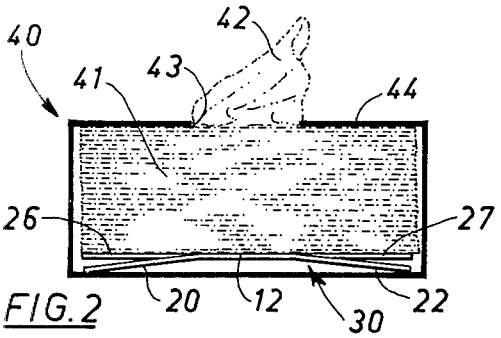
FIG. 2 is a side elevation of another embodiment of an elevating device in accordance with the invention showing that device inserted below a stack of facial tissues in a box or container of a conventional type and shown in section.
Figure 3:
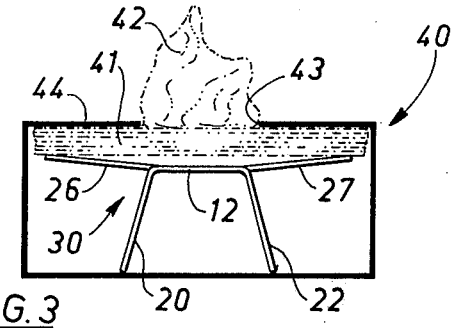
FIG. 3 is a side elevation similar to that of FIG. 2 but showing the position of the elevating device after several tissues have been removed from the box or container.

In the device generally indicated at 30 in FIGS. 2 and 3, the fingers 26 and 27 are deformed so as normally to extend angularly upwardly at a small angle to the plane of the platform 12 whereas, in the elevating device 10 shown in FIG. 1, the fingers 26 and 27 are essentially coplanar at all times with the principal plane of the platform 12. Otherwise, the devices 10 and 30 are identical and accordingly identical component parts thereof are identified by the same legends in all the figures of the accompanying drawings.

In use, a device in accordance with this invention is inserted into a conventional box 40 containing a stack 41 of facial tissues, a topmost one 42 of which is shown as being partially withdrawn through a discharge opening 43 formed in the top wall 44 of the box, the device 10 or 30 being introduced into the box during or prior to the insertion of the stack 41 of tissues thereinto. Insertion of the device into a pre-packaged box of tissues is, however, also within the scope of this invention.

For such insertion of the device 10 or 30 into a box of tissues, the legs 20, 21 and 22, 23 of the device are splayed apart as shown in FIG. 2 so that the device is disposed below the stack 41 of tissues. The resilience of the material from which the device 10 or 30 is formed urges the legs 20, 21 and 22, 23 to flex inwardly to the relative positions shown in FIG. 3 as tissues are progressively removed through the discharge opening 43 in the top wall 44 of the box 40.

It will now be understood that the devices 10 and 30 are effective to maintain the stack 41 of tissues in abutment with the undersurface of the top wall 44 of the box 40 as the tissues are sequentially removed from the box. In the case of the device 30, the fingers 26 and 27 will also flex slightly upwardly as shown in FIG. 3 by virtue of their natural resilience as tissues are removed from the box 40.

Although the invention is not restricted to elevating devices manufactured in any particular manner, one particularly effective procedure for manufacturing such a device will now be described with particular reference to FIGS. 4 and 5 of the accompanying drawings.

Figure 4:
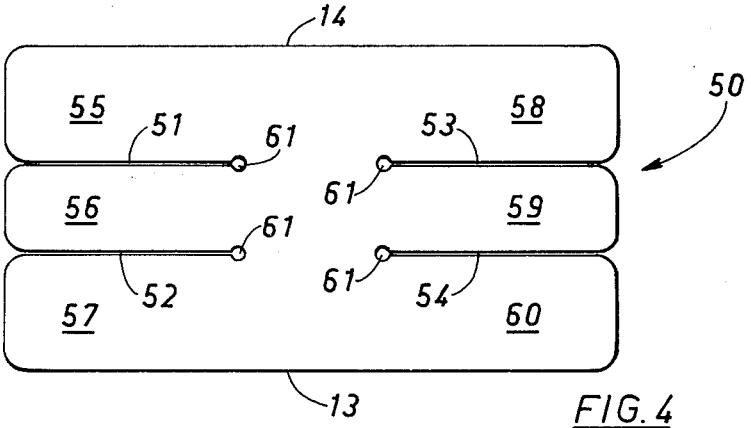
FIG. 4 is a plan view of a sheet of resiliently flexible plastics material usefully used for the manufacture of the elevating devices as shown in FIGS. 1 to 3 after an initial stage in the manufacture of such a device has been completed.
Figure 5:
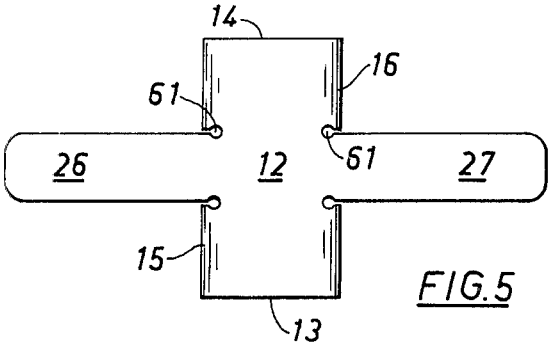
FIG. 5 is a plan view similar to that of FIG. 4 but on a reduced scale and after a further stage in the manufacture of the device has been completed.

Such a manufacturing procedure involves cutting a generally rectangular sheet generally indicated at 50 in FIG. 4 of a suitable resiliently flexible plastics material to form two transversely spaced apart and open-ended slots 51, 52 and 53, 54 from opposite ends of the sheet 50 so as to define longitudinally extending tongues 55, 56, 57 and 58, 59, 60. Usefully the corners of the sheet and the inner ends of the slots 51, 52, 53 and 54 are rounded as indicated at 61 to reduce the risk of tearing of the sheet 50 in use.

With the slots so formed, the outer tongues 55, 57 and 58, 60 are deformed downwardly generally to the positions shown in FIGS, 1, 3 and 5. Such deformation is performed in such a way that the deformed positions described are the relaxed or unflexed positions from which the legs can be resiliently splayed apart in the manner already explained. For example, if the device 10 or 30 is manufactured from a sheet of a heat-formable thermoplastic material such as polyethylene, the deformation of the tongues 55, 57, 58 and 60 will be carried out at a suitably elevated temperature so that the legs 20, 21 22 and 23 naturally return to their unflexed positions shown in FIGS. 1 and 3 in the manner already described herein.

The selection of a suitable material for the construction of the elevating devices of this invention will be affected by many factors. Polyethylene has, however, proved to be particularly suited for such a purpose in view of its low cost and the ease with which it can be cut and folded at relatively low temperatures. Particularly effective devices have been manufactured using polyethylene sheet having a thickness of about one sixteenth inch.

It will also be understood that numerous modifications and variations can be made in the structures described herein without departing from the scope of the invention. As already explained, the tongues 56 and 59 of such a device can be permanently deformed slightly angularly upwardly to form the tissue-supporting fingers 26 and 27 respectively, suitably by deformation at an elevated temperature. Furthermore, more than four legs can be provided on such a device. Other variations and modifications are also possible and will be apparent to those conversant with plastic-forming technology.

What I claim as new and desire to secure by Letters Patent in the U.S. Patent Office is:

1. In combination a box containing facial tissues, said box having an aperture located centrally in the top surface of the box to provide access for removal of tissues therethrough, and an elevating device within the box underlying the tissues in supporting and elevating relation to facilitate removal of tissues, said elevating device comprising an integral one piece body formed from a single sheet of plastic material, with a pair of oppositely extending finger surfaces and a pair of laterally extending platform surfaces providing a generally planar cruciform tissue support surface lying in a plane substantially parallel with said box top, said platform surfaces each having a pair of bendable leg portions connected at the plane of said platform surfaces and flexible downwardly from said plane, said leg portions each being substantially equal in width with said finger surfaces and extending substantially parallel thereto when compressed to lie in said plane, said leg portions when extending downwardly out of said plane permitting partial downward displacement of the corners of said tissues within the box to facilitate grasping of the central portion of the topmost tissue in supported relation on said cruciform support.

2. The elevating device as claimed in claim 1 wherein said finger portions are elastically biassed upwardly to exert, in use, an upwardly displacing force on said tissues.

* * * * *